US005660698A

United States Patent [19]

Scannell et al.

[11] Patent Number: 5,660,698

[45] Date of Patent: Aug. 26, 1997

[54] ELECTRODE CONFIGURATION FOR GAS-FORMING ELECTROLYTIC PROCESSES IN MEMBRANE CELLS OR DIAPRAGM CELLS

[75] Inventors: Robert Scannell, Pfungstadt; Bernd Busse, Darmstadt, both of Germany

[73] Assignee: Heraeus Elektrochemie GmbH, Hanau, Germany

[21] Appl. No.: 513,817

[22] PCT Filed: Jan. 28, 1994

[86] PCT No.: PCT/EP94/00240

§ 371 Date: Oct. 23, 1995

§ 102(e) Date: Oct. 23, 1995

[87] PCT Pub. No.: WO94/20649

PCT Pub. Date: Sep. 15, 1994

[30] Foreign Application Priority Data

Mar. 5, 1993 [DE] Germany ..... 43 06 889.8

[51] Int. Cl.[6] ..... C25B 9/00

[52] U.S. Cl. ..... 204/252; 204/283; 204/284; 204/282; 204/286; 204/288; 204/289; 204/297 R

[58] Field of Search ..... 204/283, 284, 204/286, 288, 289, 297 R, 252, 282

[56] References Cited

U.S. PATENT DOCUMENTS

| | | | |
|---|---|---|---|
| 4,124,479 | 11/1978 | Boulton | 204/256 |
| 4,469,577 | 9/1984 | Schmitt et al. | 204/252 |
| 4,474,612 | 10/1984 | Lohrberg | 204/252 |
| 4,557,818 | 12/1985 | Roos et al. | 204/288 |
| 4,627,897 | 12/1986 | Tetzlaff et al. | 204/59 R |

FOREIGN PATENT DOCUMENTS 2110912 12/1992 Canada .

*Primary Examiner*—Bruce F. Bell
*Attorney, Agent, or Firm*—Felfe & Lynch

[57] ABSTRACT

An electrode plate of planar structure contains lamellar electrode elements, with adjacent electrode elements being separated from one another by a gap. For a better escape of the gas from the electrode/membrane area, the lamellar electrode elements are provided with an expanded-metal structure, the openings of which serve to improve the passage of gas. The electrode elements are provided with angled upper edge strips in order to facilitate the escape of gas in the vertical direction. The electrode configuration is particularly suitable as an anodically connected electrode in direct contact with an ion exchanger membrane, but can also be used as a cathode at a distance from the membrane.

14 Claims, 3 Drawing Sheets

FIG. 1a
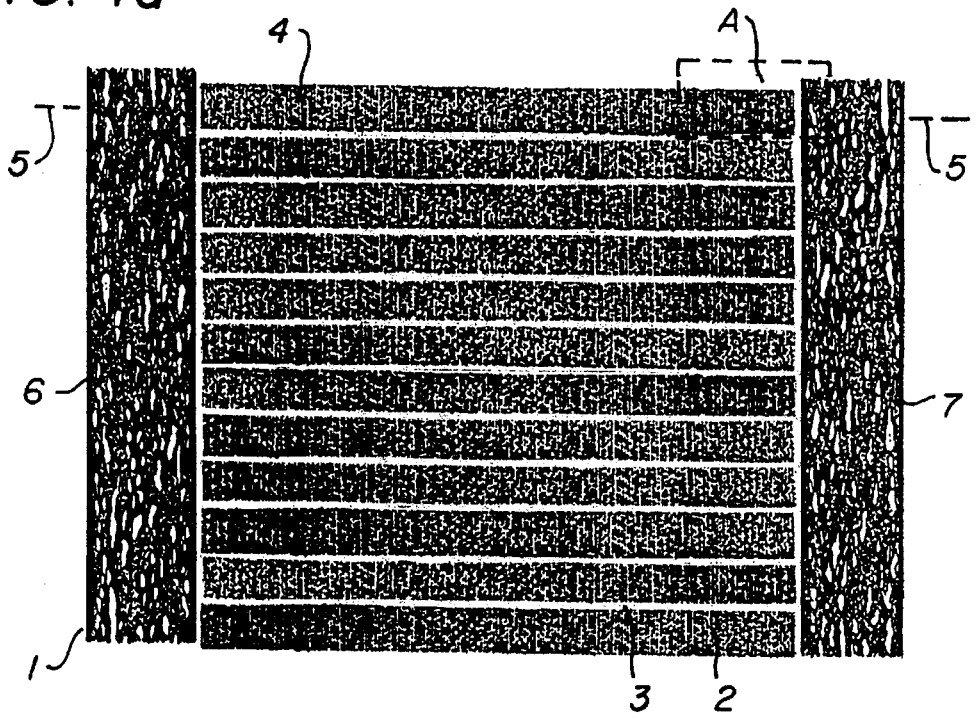
FIG. 1b
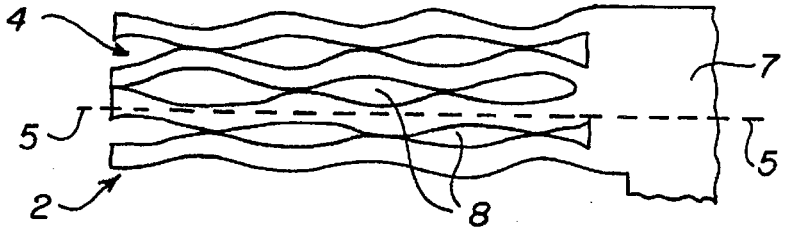
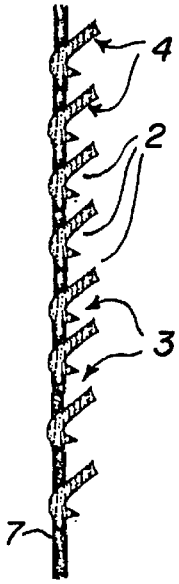
FIG. 1c

ELECTRODE CONFIGURATION FOR GAS-FORMING ELECTROLYTIC PROCESSES IN MEMBRANE CELLS OR DIAPRAGM CELLS

This is a 371 of PCT/EP94/00240 published Jan. 28, 1994.

BACKGROUND OF THE INVENTION

The invention relates to an electrode configuration for gas-forming electrolytic processes, in particular for processes in membrane cells, comprising a planar electrode structure having at least two electrically conducting and mechanically firmly interconnected electrode elements, between each of which is provided a gap for the escape of gas. The electrode elements along the gap have supporting surfaces for an ion exchanger membrane or a diaphragm and where edge areas bordering the gap are designed for the escape of gas.

A membrane electrolysis cell of the filter press type with planar-structure electrodes in pairs is known from DE-OS 32 19 704, to which U.S. Pat. No. 4,469,577 corresponds, wherein the electrodes each have at least one perforated active central portion and wherein a membrane is disposed between the paired electrodes; in each case a seal is disposed between electrode edge and membrane edge. The perforated central portion of the electrodes has a lattice-like structure, where the lattice bars of the paired electrodes are offset against one another by a maximum of half a lattice bar width and the lattice bars of one electrode are positioned such that their distance apart is less than the projection of their width. The lattice bars have at least on their active side a convex curvature, where the thickness of the seal between the electrode edge and the membrane edge is equal to or less than the height of the lattice bar portion projecting above the electrode edge. One problem is that in a configuration of this type a depletion and also gas bubbles in the vicinity of the support surface must be expected, resulting in unfavourable effects on the membrane and the electrode coating.

The electrolysis cell is intended for electrolysis of an aqueous halogenide-containing electrolyte, for example brine, in order to produce an aqueous alkali metal hydroxide solution plus halogen and hydrogen.

In cells structured in this way, a chloride depletion must be expected in the vicinity of the point of contact between the electrode and the membrane, thereby resulting in a drop in the long-term stability.

An electrode configuration for gas-forming electrolysers, in particular for membrane electrolysers, is known from EP-PS 0 102 099, to which U.S. Pat. No. 4,474,612 corresponds, having vertically disposed plate electrodes, a back electrode and a membrane between the two electrodes. The plate electrode is divided here into horizontal strips, the entire active electrode surface of which is disposed parallel to and at a very short distance from the back electrode, but with a gap being provided between the membrane and the electrode for the escape of the gas generated by the electrochemical transformation process. In order for the gas rising from the electrode gap to escape, the horizontal strips are each provided in the vicinity of their top edges with an angled gas escape element at which the rising gas expands and part of which is routed to behind the electrode.

The electrode gap between the membrane and the two electrodes that is always necessary for the gas to escape proves to be a problem here, as this relatively large electrode spacing also entails an increase in the cell voltage.

An electrode configuration for gas-forming electrolysers is known from DE-OS 36 40 584, to which U.S. Pat. No. 4,839,013 corresponds, in particular for monopolar membrane electroiysers having vertically disposed plate electrodes plus back electrodes and a membrane between plate electrode and back electrode. Electrically conductive planar structures connected in electrically conductive manner to the plate electrodes on those surfaces of these electrodes facing the membrane are known as pre-electrodes, and run in parallel planes to the plate electrodes.

The planar structure used as an electrode is designed in the form of perforated plates, expanded metals, wire fabrics or wire meshes, with the spacing of the planar structures ranging from 1 to 5 mm; the plate electrodes are horizontally divided all the way through into several separate units in order to improve the current distribution in the membrane and to reduce the voltage drop on the surfaces facing the membrane.

The problem with such electrodes is the chloride depletion, in particular in the vicinity of the point of contact between electrode and ion exchanger membrane, thereby resulting in a reduction in the long-term stability.

Furthermore, a process for electrolysing liquid electrolytes by means of perforated electrodes in electrolysis cells divided by the ion exchanger membrane is known from EP-OS 0 150 018, to which U.S. Pat. No. 4,627,489 corresponds, in which a gas area is created by gas bubble formation lateral to the main flow direction of the electrolyte. After bursting at the phase boundary, the resultant gas bubbles transfer their gas content to the adjacent gas area lateral to the main flow direction, said area being formed by the rear space behind the electrode in the case of plate-like electrodes. The perforated electrodes can comprise expanded metals or sheet metal strips, among other materials.

In configurations known from EP-OS 0 150 018, the relatively expensive structure based on electrodes with gas-flow-guiding elements comprising single sheet metal strips presents problems.

SUMMARY OF THE INVENTION

The object underlying the invention is to develop an electrode configuration with an open structure, if necessary with a grid-like design, the aim being to achieve during operation a rapid escape of gas bubbles at high efficiency with increased electrolyte exchange in the area between electrode and membrane. In addition, the electrode configuration should be simple to make, its long-term stability increased, and an enlargement of the catalytically active surface achieved.

According to the invention, the support surfaces of the electrode elements are permeable to liquid and gas. The electrodes are vertically arranged and have edge strips extending from respective support surfaces at an angle of 20°–35° from the vertical plane. The edge strips are provided with means for gas to escape vertically.

The simple production of the electrode configuration in particular has proved to be advantageous; furthermore, the varied possibilities for use, for example directly resting on the membrane as well as a cathode at a distance from the membrane have proved advantageous. Furthermore, it is possible, thanks to the electrodes being provided with expanded metal openings, to achieve a rapid escape of the gas; in electrochemical cells with the electrode in accordance with the invention, a relatively low cell voltage can be achieved compared with conventional membrane cells, thereby ensuring considerable energy savings.

BRIEF DESCRIPTION OF THE DRAWINGS

FIG. 1*a* is a plan view of the electrode configuration,

FIG. 1*b* shows a detail of section A from FIG. 1*a;*

FIG. 1*c* shows a cross-section in the profile of the electrode configuration.

DETAILED DESCRIPTION OF THE INVENTION

Figure 2:
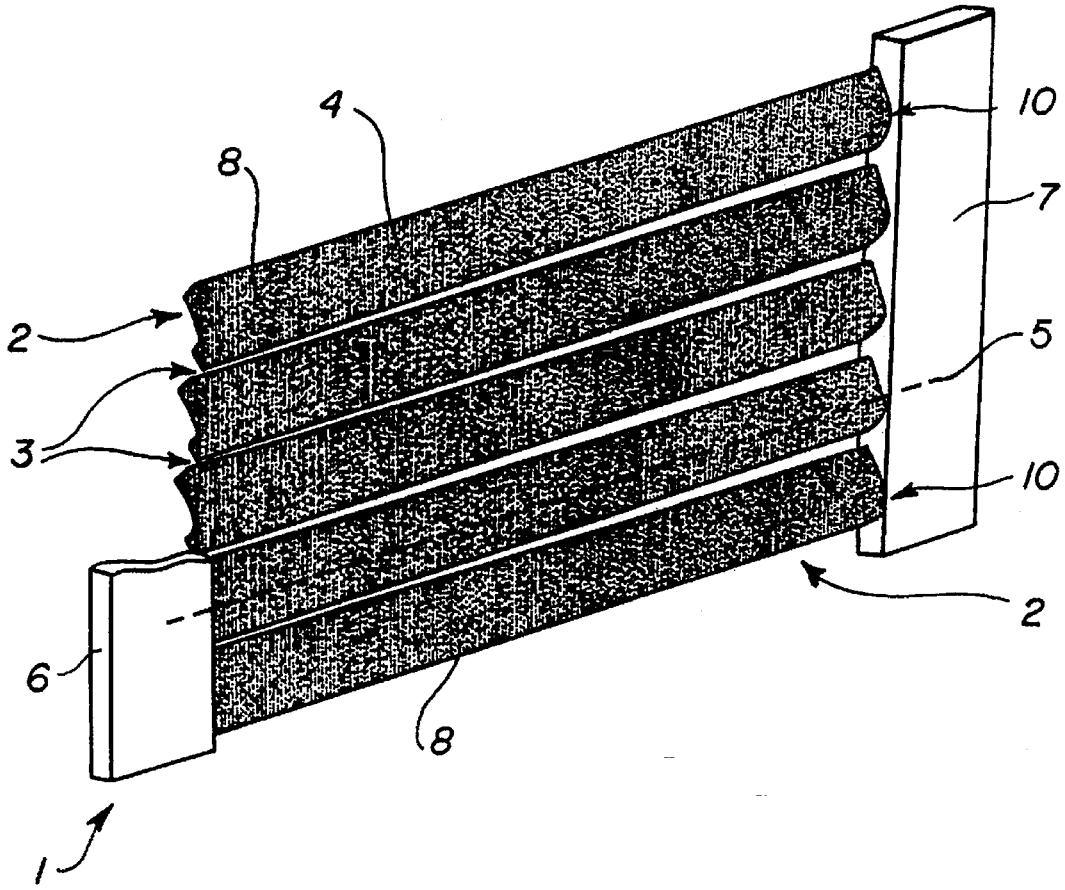
FIG. 2 shows in a perspective view a partially cutaway electrode configuration.

As shown in FIG. 1*a*, the electrode configuration 1 made from an electrode plate of planar structure has a plurality of electrode elements 2 arranged in lamellar form and each separated from one another by a gap 3; the upper edges 4 of the electrode elements 2 are angled on the side facing away from the membrane along a line 5 shown in the diagram, in order to achieve a rapid gas escape of the bubbles generated in the area of the electrodes. As FIG. 1*b* shows, the substantially rhomboidal openings 8 of the expanded metal shown in diagram form are discernible, with an increase in the active surface being achievable in the range from 1.1 to 1.3 in spite of the openings; this means that the electrochemically effective electrode surface is increased by the expanded metal openings to an area of 1.15 $cm^2$, compared to a closed area of, for example, 1 $cm^2$.

Expanded metal with a strip thickness in a range from 1.5 to 4 mm is advantageously used. The long dimension of the opening (LWD) is in the range from 2 to 4.5 mm, the short dimension of the opening (SWD) in the range from 1.2 to 3 mm.

The openings in the area of the catalytically active electrode surface permit better mixing of the electrolyte gas bubble mixture with a better escape of gas bubbles, thereby achieving an improvement of the long-term stability in the area of the membrane and the anodically connected electrode; the anodically connected electrode is here in direct contact with the membrane.

As shown exaggerated in FIG. 1*c*, the angle between the upper edge strips 4 and the plane of the electrode configuration 1 is about 30°.

Suitable materials for the electrode are in particular sheet titanium with precious metal and non-precious metal activation, or sheet nickel with precious metal activation.

The electrode configuration has proved itself in particular for use as an anode and cathode in a membrane cell for chlorine/alkaline electrolysis or hydrogen/oxygen generation.

The edge strips 6 and 7 comprise either expanded metal or closed sheet metal.

FIG. 2 shows the openings 8 necessary for the gas to escape inside the electrode elements 2, and the separation of the gas electrolyte mixture into an electrolysis portion and a gas portion to escape that is possible with the gap 3 and the angled upper edges 4. If the electrode is anodically connected, the membrane is in direct contact with the support surface 10, while the rear area extending into the electrolyte space is for the gas to escape. In the case of a cathodic connection of the electrode, spacer elements are provided between the support surface 10 of the electrode configuration 1 and the ion exchanger membrane, not shown. These spacers comprise electrolyte-resistant material, which is however also not shown here.

Figure 3:
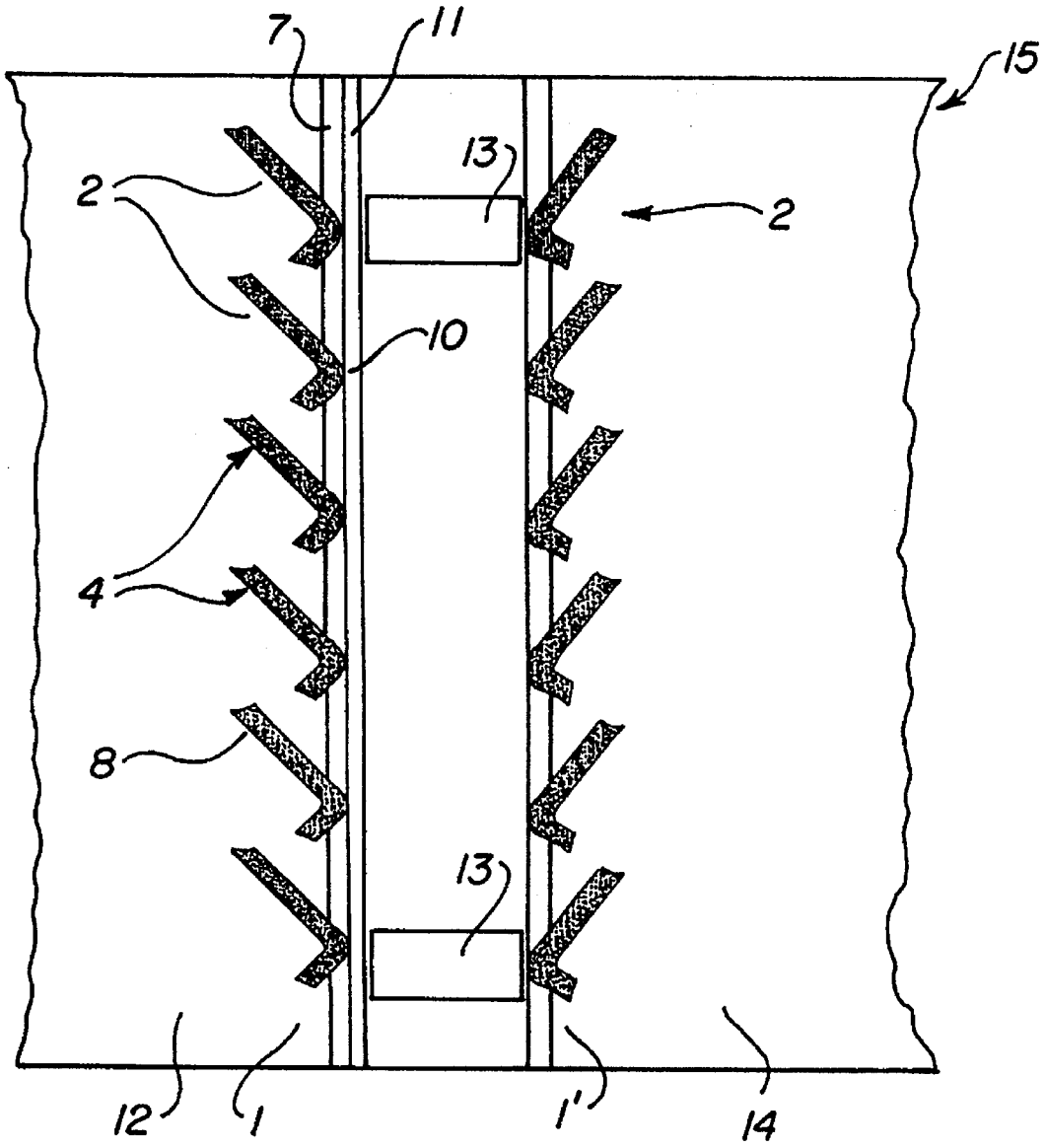
FIG. 3 shows the operation of the electrode configuration in a membrane electrolysis cell in diagram form and in a partial view.

FIG. 3 shows in a diagrammatic cross-section a single membrane cell unit, with only the ion exchanger membrane with cathode and anode being shown in cross-section, while dispensing with the illustration of the associated peripherals such as clamping elements, current cables and gas escape means in the interests of greater clarity.

As FIG. 3 shows, the anodically switched electrode 1 is in direct contact by its support surface 10 with the surface of the diagrammatically illustrated membrane 11, with the requirement for rapid escape of the gas being clearly discernible thanks to the openings 8 in the area of the electrode elements only being shown in diagram form. The gas bubbles, not shown here, flow upwards in the vertical direction because of their reduced specific weight compared with electrolyte 12, and are there collected and passed on by collection means, not shown here. A corresponding process also takes place on the opposite side of the membrane 11 by means of the cathodically connected electrode 1'; it must however be noted that the cathodic electrode is positioned at a distance from the membrane in order to achieve a substance exchange and stability of the membrane, for example separated by means of spacers from the ion exchanger membrane 11 in order to achieve a spacing of 1 to 3 mm; it is however also possible to obtain a space between the membrane and the cathodic electrode by means of a pressure difference. Here too, the escape of gas bubbles in the vertical direction out of the catholyte 14 occurs, with a gas collecting means not shown here also being provided. The cell vessel shown in part and containing anolyte and catholyte is identified with the reference number 15.

The membrane cell configuration is suitable in particular for electrolysis cells for chlorine generation, however it can also be used for hydrogen/oxygen generation.

We claim:

1. Electrode for gas forming electrolytic processes in a membrane cell or a diaphragm cell, said electrode comprising a plurality of electrically conducting electrode elements having gaps therebetween, each element having a support surface for a membrane or diaphragm, and at least one edge strip flanking said support surface, said support surface being permeable to liquid and gas, said edge strips providing means for gas to escape, and means for firmly mechanically interconnecting said electrode elements.

2. Electrode as in claim 1 wherein said support surfaces are in a single plane.

3. Electrode as in claim 1 wherein said electrode elements are permeable to liquid and gas in entirety.

4. Electrode as in claim 1 wherein said electrode elements are formed of expanded metal.

5. Electrode as in claim 4 wherein said electrode elements have an electrocatalytically effective surface and a geometric surface, the ratio of electrocatalytically effective surface to geometric surface being in the range of 1.1:1 to 1.3:1.

6. Electrode as in claim 1 wherein said means for mechanically connecting said electrode elements comprise a pair of parallel support strips, said electrode elements extending between said parallel support strips in a single plane.

7. Electrode as in claim 1 wherein said electrode elements are formed of porous metal.

8. Electrode as in claim 7 wherein said electrode elements are formed of one of sintered titanium and sintered nickel.

9. Electrode as in claim 7 wherein said porous metal has pores with a size on the order of the maximum size of gas bubbles formed during electrolysis.

10. Electrode as in claim 1 wherein each electrode element comprises an upper edge strip and a lower edge strip which converge toward said support surface, each said element having a V-shaped cross-section.

11. Membrane cell for gas forming electrolytic processes, said cell comprising a plurality of electrically conducting electrode elements having gaps therebetween, each element having a support surface for a membrane or diaphragm, and at least one edge strip flanking said support surface, said support surface being permeable to liquid and gas, said edge strips providing means for gas to escape, means for firmly mechanically interconnecting said electrode elements so that said support surfaces are in a single plane, and a planar ion-exchange membrane which is received against said support surfaces, said ion-exchange membrane being vertically arranged.

12. Membrane cell as in claim 11 wherein said electrode elements have an active surface area and a geometric surface area, said active surface area being 1.1 to 1.3 times greater than the geometric surface area.

13. Membrane cell as in claim 11 wherein each element comprises an upper edge strip and a lower edge strip which converge toward said support surface, each said element having a V-shaped cross-section.

14. Membrane cell as in claim 13 wherein said upper edge strip and said membrane form an angle of 20°–35°.

* * * * *

UNITED STATES PATENT AND TRADEMARK OFFICE

CERTIFICATE OF CORRECTION

PATENT NO. : 5, 660, 698

DATED : Aug. 26, 1997

INVENTOR(S) : Scannell et al.

It is certified that error appears in the above-identified patent and that said Letters Patent is hereby corrected as shown below:

On the cover, in the title on line 3, change "DIAPRAGM" to - - DIAPHRAGM - - .
In column 1, line 3, change "diapragm" to - - diaphragm - -.
In column 2, line 24, change "4,627,489" to - - 4,627,897 - -.

In column 3, line 21, after "openings" add - - 8 - -.
In column 3, line 39, after "... about 30°." insert - - An angle of between 20° and 35° has proved advantageous. - -.

Signed and Sealed this

Twenty-second Day of August, 2000

*Attest:*

Q. TODD DICKINSON

*Attesting Officer*

*Director of Patents and Trademarks*